US010349753B2

(12) United States Patent
Rox

(10) Patent No.: US 10,349,753 B2
(45) Date of Patent: Jul. 16, 2019

(54) SOFA-BED AIR MATTRESS COMBINATION

(71) Applicant: Jill Rox, New Smyrna Beach, FL (US)

(72) Inventor: Jill Rox, New Smyrna Beach, FL (US)

( * ) Notice: Subject to any disclaimer, the term of this patent is extended or adjusted under 35 U.S.C. 154(b) by 502 days.

(21) Appl. No.: 15/174,397

(22) Filed: Jun. 6, 2016

(65) Prior Publication Data

US 2016/0278533 A1 Sep. 29, 2016

Related U.S. Application Data

(63) Continuation-in-part of application No. 14/254,029, filed on Apr. 16, 2014, now abandoned.

(60) Provisional application No. 61/812,783, filed on Apr. 17, 2013.

(51) Int. Cl.

| | |
|---|---|
| ***A47C 27/08*** | (2006.01) |
| ***A47C 17/13*** | (2006.01) |
| ***A47C 7/62*** | (2006.01) |
| ***A47C 17/04*** | (2006.01) |
| ***A47C 17/22*** | (2006.01) |

(52) U.S. Cl.

CPC ..... *A47C 27/082* (2013.01); *A47C 7/62* (2013.01); *A47C 17/04* (2013.01); *A47C 17/13* (2013.01); *A47C 17/22* (2013.01)

(58) Field of Classification Search

CPC ..... A47C 27/082; A47C 17/22; A47C 17/04; A47C 7/62; A47C 17/13

USPC ..... 5/58, 706

See application file for complete search history.

(56) References Cited

U.S. PATENT DOCUMENTS

| | | | | |
|---|---|---|---|---|
| 2,494,838 | A * | 1/1950 | Slaughter | A47C 7/70 297/145 |
| 4,442,556 | A | 4/1984 | Craigie | |
| 4,586,206 | A * | 5/1986 | Singer | A47C 17/225 5/12.1 |
| 4,694,515 | A | 9/1987 | Rogers, Jr. | |
| 4,712,261 | A | 12/1987 | Castro | |
| 6,108,844 | A | 8/2000 | Kraft | |
| 6,161,231 | A * | 12/2000 | Kraft | A47C 17/22 5/12.1 |
| 7,827,629 | B1 * | 11/2010 | Guillot | A47C 17/20 5/12.1 |
| 2003/0084507 | A1 | 5/2003 | Timoshenko | |
| 2006/0179566 | A1 * | 8/2006 | James | A47C 17/225 5/12.1 |
| 2007/0006384 | A1 * | 1/2007 | Worman | A47C 4/54 5/706 |

* cited by examiner

*Primary Examiner* — Robert G Santos
*Assistant Examiner* — Myles A Throop

(57) ABSTRACT

The invention is directed to a sofa-bed combination, having an inflatable air mattress, rather than a foam or spring mattress. A bed base would pull out from sofa base to provide sufficient support for the air mattress. Contained within storage spaces in the arms of the sofa would be an inflatable bladder forming a mattress. The sofa-bed features an electric air pump, which would rapidly inflate and deflate the mattress for use or stowage.

9 Claims, 3 Drawing Sheets

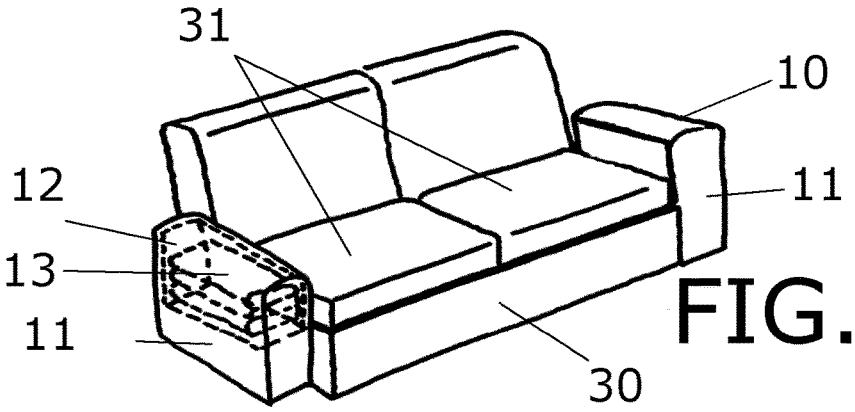
FIG. 1
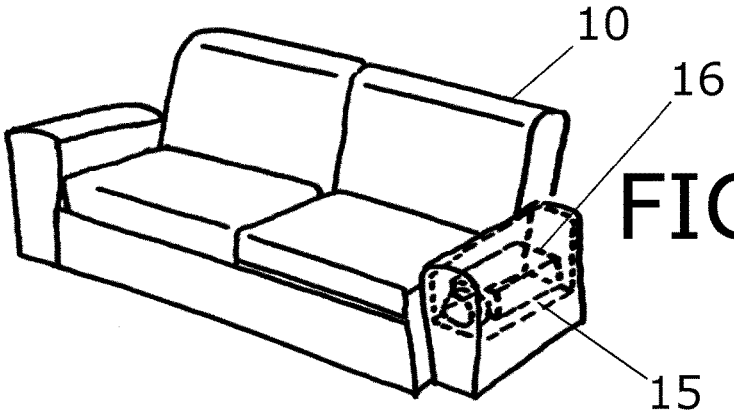
FIG. 2
FIG. 3
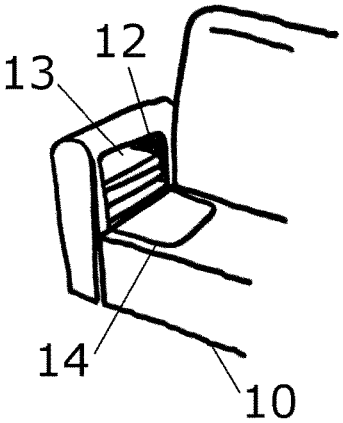
FIG. 4
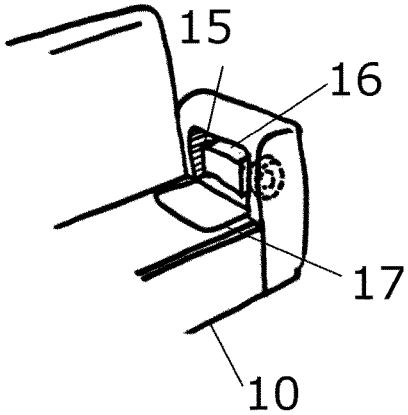

SOFA-BED AIR MATTRESS COMBINATION

CROSS-REFERENCE TO RELATED APPLICATIONS

This application claims the benefit under 35 U.S.C. 120 of U.S. Non-Provisional application Ser. No. 14/245,029, filed Apr. 16, 2014 which claimed priority to U.S. Provisional Application No. 61/812,783, filed Apr. 17, 2013, which are hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to multi-purpose furniture, and in particular to a sofa-bed air mattress combination. To save space in small apartment, condominiums and mobile homes, various configurations of multi-purpose furniture have long been in use that can serve as a sofa by day, and as a bed by night. One such configuration folds a mattress into itself beneath seating cushions. The mattress and frame, however, are massive and heavy, taking up space within the design and adding substantial weight. The cross members necessary to support the mattress are also uncomfortable for the user. Replacing the conventional mattress with an air mattress that is stowed in an arm of the sofa would take up much less space, and add less weight to the design. Particularly for overnight guests, this would provide a comfort advantage over a standard pull-out bed, and a convenience and practicality advantage over conventional mattresses.

A search of the prior art reveals various sofa beds which have been developed to serve as a sofa by day, and as a bed by night. None are closely related to the present invention, but several include features which resemble those of the present invention. Each has proven to be less than satisfactory in its own way. The present invention has been developed for the purpose of addressing and resolving these disadvantages.

Sofa bed with inflatable mattress, U.S. Pat. No. 4,442,556 (filed Mar. 1, 1983), provides a sofa bed including a fixed frame which is provided with a conventional foldable, sectional sofa bed frame. The sofa bed frame is foldable and unfoldable between collapsed and extended positions in a conventional manner. The sofa had also includes a sectional mattress which includes inner, outer and intermediate inflatable mattress sections which are hingedly connected together. The mattress sections in the unfolded condition serve as a full mattress, and when in the folded condition constitute part of the sofa.

Chair, U.S. Pat. No. 2,494,838 (filed Dec. 29, 1945), provides a chair or divan especially one of the upholstered or overstuffed type, whose arm rests are convertible into tables for writing, supporting refreshments, or the like, by virtue of a pair of coaxial plates or boards hinged together along one edge so that one may be moved to overlie the other in one position and become parallel with the latter in another position. The movable board is upholstered on one side while the opposite side, as is the exposed side of a companion board is appropriately finished to constitute jointly with the other a table top in which the flanges of the hinges, preferably of the piano type, are countersunk.

Seating/sleeping systems and methods, U.S. Patent Appl. Publ. No. 2007/0006384 (filed Jun. 28, 2005), provides a seating/sleeping system which includes: a lower support layer; a cushion that is located above the support layer and that is supported by the support layer, the cushion being configured to support buttocks of a person sitting on the seating/sleeping system; a back support layer that is located above the lower support layer, the back support layer being configured to support a back of a person sitting on the seating/sleeping system; and an air mattress that is connected to the seating/sleeping system and that is located within the seating/sleeping system, the air mattress configured to be inflated while remaining connected to the seating/sleeping system.

Mattress guard, U.S. Pat. No. 4,712,261 (priority Mar. 20, 1985), provides a mattress guard for use in a convertible sofa bed having an air inflatable mattress supported on the mattress support of a folding bed mechanism frame. The mattress guard includes a pair of flexible guard members adapted to be placed on opposed edges of the mattress, elastic straps resiliently securing the guard members together along the top surface of the mattress and attachment devices for securing the guard members to the mattress support below the mattress. The guard members hold the bedding for the mattress securely against the mattress and prevent it from becoming entrapped in the folding mechanism when the bed is folded. In addition, the mattress will be compressed when air is released therefrom prior to folding of the sofa bed to space its edges away from the mechanism.

Most of these inventions provide furniture designs with storage compartments. Some of these inventions provide air mattresses, but provide heavy and uncomfortable bed frames and cross members which provide no improvement over the traditional pull-out folding bed. This creates various disadvantages. The furniture is difficult to move, either for the purpose of relocating to a new residence, or for the purposes of rearranging the furniture or cleaning. Furthermore, the bed is uncomfortable and does not provide a good night's sleep. These disadvantages make the prior art inventions less than ideal. The present invention, which provides a solid shell bed base without a frame, resolves the disadvantages of the prior art and is not anticipated by the prior art.

A sofa-bed air mattress combination, which provides a solid shell bed base and a folded air mattress stored in an arm of the sofa, would help to resolve these disadvantages.

SUMMARY OF THE INVENTION

Accordingly, the invention is directed to a sofa-bed air mattress combination, having an inflatable air mattress, rather than a foam or spring mattress. A bed base would pull out from beneath the frame of the sofa. Contained within a storage compartment in an arm of the sofa would be an inflatable bladder forming an air mattress. The sofa-bed features an electric air pump, which would rapidly inflate and deflate the mattress for use or storage.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 1 shows a front perspective view of the first exemplary embodiment, displaying the sofa, the first storage compartment, the arms, and the air mattress.

FIG. 2 shows a front perspective view of the first exemplary embodiment, displaying the sofa, the second storage compartment, and the electric air pump.

FIG. 3 shows a front perspective view of a left portion of the first exemplary embodiment with a door opened, displaying the sofa, the first storage compartment, the air mattress.

FIG. 4 shows a front perspective view of a right portion of the first exemplary embodiment with a door opened, displaying the sofa, and the electric air pump.

DETAILED DESCRIPTION OF THE INVENTION

Figure 5:
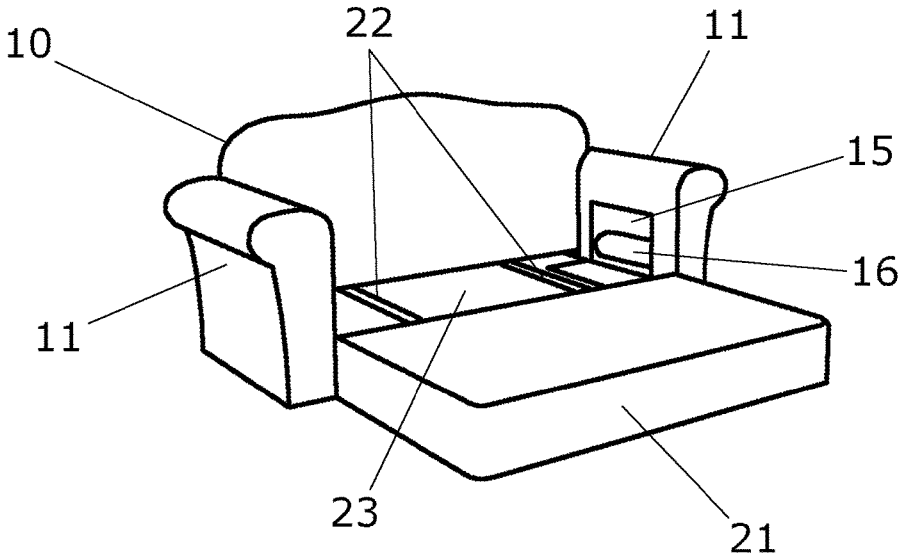
FIG. 5 shows a front perspective view of a third exemplary embodiment displaying the sofa and a sliding extendable base.
Figure 6:
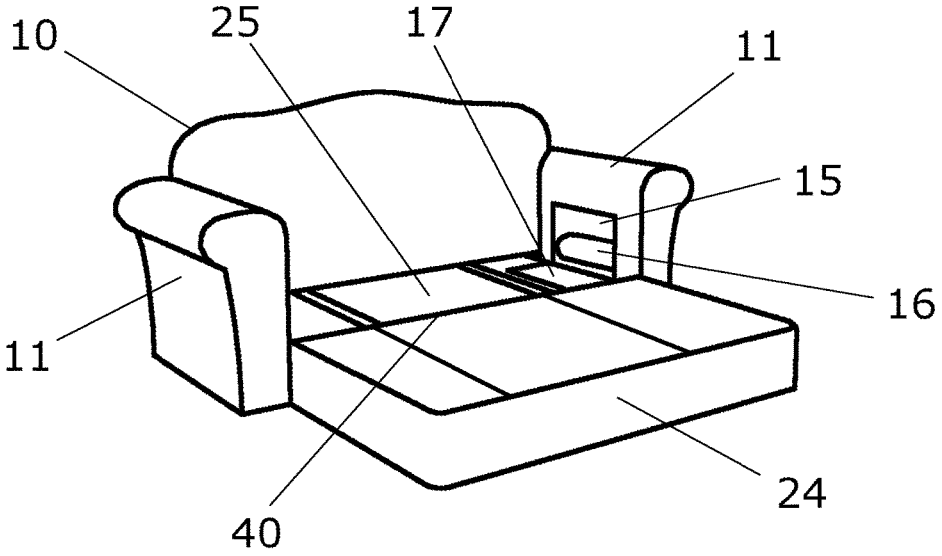
FIG. 6 shows a front perspective view of a fourth exemplary embodiment displaying the sofa and a folding extendable base.
Figure 7:
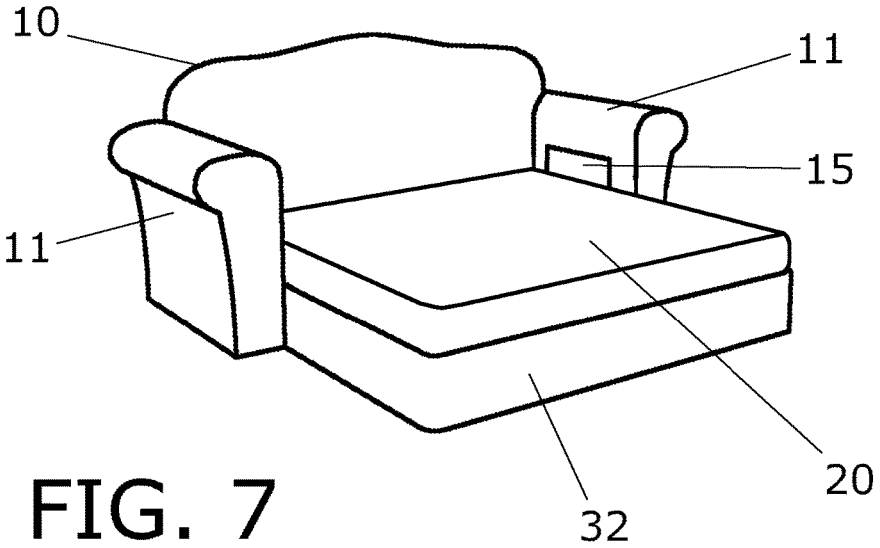
FIG. 7 shows a front perspective view of the fourth exemplary embodiment displaying the sofa with the mattress inflated.

Referring now to the invention in more detail, the invention is directed to a sofa-bed combination, having an inflatable air mattress, rather than a foam or spring mattress. An air mattress 13 is pulled out from a storage compartment 12 within one of the arms 11 of the sofa 10. The sofa base 30 of the sofa 10 provides a solid shell and is sized to accommodate sofa cushions 31. The sofa base 30 is formed by a plurality of sections such that the sofa base 30 is capable of extending outward to form a bed base 32. The bed base 32 is sized to accommodate the air mattress 13 when inflated. The bed base 32 has no wire or member frame or cross members which are found in traditional fold out couches. Thus, the bed base 32 provides greater comfort when the sofa-bed combination is used as a bed because it provides even support for the mattress. The bed base 32 is preferably manufactured from a rigid or semi-rigid durable material with a high ratio of tensile strength to weight, such as titanium alloy or para-aramid synthetic fiber (Kevlar™). The air mattress 13 features a connection valve. One of the two arms 11 of the sofa 10 features an electric air pump 16 within a second storage compartment 15, which would rapidly inflate and deflate the air mattress 13 for use or storage. The electric air pump 16 features a three-way switch, which can be used to select inflation or deflation, or shut off the electric air pump 16. The power supply for the electric air pump 16 would preferably be standard household current, accessed via a wire connected to a grounded wall outlet.

In the first exemplary embodiment, as illustrated by FIGS. 1-4, the air mattress 13 is folded and stored within a first storage compartment 12 within one of the two arms 11 of the sofa 10, and is accessible via a door 14. The electric air pump 16 is removably or fixedly mounted within either the same first storage compartment 12 or a second storage compartment 15. The electric air pump 16 may be stored opposite the air mattress 13, or may be stored together within the same storage compartment 12, or the electric air pump 16 may be integral to the air mattress 13. The air mattress 13 may be entirely separate, or may be removably affixed to the sofa 10, to allow replacement in case of damage; example fasteners include elastic cordage, strips of hook and loop fastener, snaps, etc. The user may also upgrade or otherwise change the air mattress 13 used in conjunction with the sofa 10 to meet their needs.

To use the first exemplary embodiment, the user removes the cushions 31 from the sofa 10, unfolds the sofa base 30 to form the bed base 32, and then opens both doors 14 and 17 found in both arms 11 of the sofa 10. The user removes the air mattress 13 from one of the arms of the sofa 10, unfolds the air mattress 13 across the bed base 32, then connects the air mattress 13 to the electric air pump 16. The user then turns the three-way switch on the electric air pump 16 to select inflation.

As the air mattress 13 inflates, the increasing size and air pressure of the air mattress 13 will cause the air mattress 13 to fully unfold across the bed base 30 of the sofa 10, and will be supported evenly by the bed base 32. When the air mattress 13 is fully inflated, the user shuts off the electric air pump 16 using the three-way switch, closes the connection valve, and disconnects the air mattress 13 from the electric air pump 16. The electric pump 16 can then be stowed in one of the arms 11 of the sofa 10, within one of the storage compartments (12 or 15). To restore the sofa 10 to its original configuration, the user connects the air mattress 13 to the electric air pump 16, opens the connection valve, and uses the three-way switch to select deflation. During the course of deflation, the user gradually folds up the air mattress 13. When the air mattress 13 is fully deflated, the user shuts off the electric air pump 16 using the three-way switch, disconnects the air mattress 13, stows the air mattress 13 in one of the arms 11 of the sofa 10, within one of the storage compartments (12 or 15) closes both doors (14 and 17), and replaces the cushions 31 on the sofa 10.

In a second embodiment of the invention the sofa base 30 is formed by a combination of a sliding base 21 and an inner base 23. The sliding base 21 is a hollow shell which fits over an inner base 23. When the sliding base 21 is stored over the inner base 23, the combination forms the sofa base 30 such that the size and shape of the sofa base 30 is the same as the sofa cushions 31. The sliding base 21 can be extended outwardly from the inner base 23 to form the bed base 32. The sliding base 21 slides along tracks 22 on the top surface of the inner base 23. When fully extended, the sliding base 21, when combined with the inner base 23, form a bed base 32 which provides a larger area of support that is sized and shaped with the same dimensions as the air mattress 13. The air mattress 13 can then be inflated in much the same way as the first embodiment.

In a third embodiment of the invention the sofa base 30 is formed by a folding base 24 positioned on top of a lower base 25. When in a stowed position, the folding base 24 rests on top of a lower base 25, the combination forms the sofa base 30 such that the size and shape of the sofa base 30 is the same as the sofa cushions 31. When extended, the folding base 24 rotates around a connected edge 40 to lie flat and adjacent to the lower base 25. When rotated out and sitting adjacent, the sliding base 21, when combined with the inner base 23, form a bed base 32 which provides a larger area of support that is sized and shaped with the same dimensions as the air mattress 13. The air mattress 13 can then be inflated in much the same way as the first embodiment. There may be multiple folding base 24 sections such that multiple sections lie adjacent to each other after being unfolded from the sofa base 30 position.

The frame of the sofa 10 and the doors (14 and 17) would preferably be manufactured from durable, rigid materials such as steel, aluminum, and wood. The padding of the sofa 10 and the doors (14 and 17) would preferably be manufactured from foam rubber and cotton batting, covered with flexible upholstery materials that are easily cleaned, such as wool, cotton, a cotton-rayon blend, a cotton-polyester blend, or leather. The air mattress 13 would preferably be manufactured from a durable, flexible material capable of inflation, such as plastic or rubber. The sofa base 30, bed base 32, the sliding base 21, inner base 23, folding base 24, and lower base 25 would preferably be manufactured from a rigid or semi-rigid durable material with a high ratio of tensile strength to weight, such as titanium alloy or para-aramid synthetic fiber (Kevlar™). Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A sofa and air mattress combination capable of a sofa configuration and an open or bed configuration, said bed configuration further comprising a sliding configuration, and a foldout configuration comprising a sofa, an inflatable air mattress removeably affixed to said sofa, and a bed base, wherein:

(a) the sofa further comprises:

i. a pair of arms, a back, one or more cushions and an open area beneath a solid shell base frame without a fixed lateral structural bed support member, wherein said shell base surrounds the open area of the sofa and is capable of containing the bed base;

ii. at least one storage compartment capable of storing said air mattress and including a hidden door, wherein said storage compartment(s) and door are concealed within at least one of the arms; and (b) the inflatable air mattress is foldable and capable of storage within said at least one storage compartment when not inflated, and is sized and shaped to conform to the bed base when the bed base is extended and the air mattress is inflated; and wherein the bed base is configured to surround and stabilize the inflatable air mattress, and the air mattress is configured to conform to the bed base when the bed base is extended and the air mattress is inflated; and (c) the bed base includes a plurality of sections, wherein said plurality of sections conform to the shape of, and are stored in the area beneath the shell base frame of the sofa when closed in the sofa configuration, and further comprise at least one of a folding base and a sliding base.

2. The sofa and air mattress combination of claim 1, wherein the solid shell base frame surrounds a folding base or a sliding base that slides or folds out from beneath the frame of the sofa and flattens to provide a solid bed support for the air mattress; said shell base is positioned on top of a lower base and is connected to said lower base via a connected edge when in a stowed configuration; said folding base or said sliding base extends outward from said lower base by sliding the sliding base outward across said lower base, or rotating the folding base around said connected edge such that said folding base or sliding base lies adjacent to said lower base and supports and contains said air mattress.

3. The sofa and air mattress combination of claim 1, further comprising an air pump; wherein said at least one storage compartment is equal to two in number; said air mattress being stored within a first storage compartment; said first storage compartment having a first door; said air pump being stored within a second storage compartment; and said second storage compartment having a second door.

4. The sofa and air mattress combination of claim 3, wherein said first storage compartment is located in one of said arms and said second storage compartment is located in the second of said arms.

5. The sofa and air mattress combination of claim 3, wherein said air mattress is removeably or permanently affixed to said sofa within one of said first storage compartment or said second storage compartment.

6. The sofa and air mattress combination of claim 3, wherein said air pump is removeably or permanently affixed to said sofa within one of said first storage compartment or said second storage compartment.

7. The sofa and air mattress combination of claim 1, wherein said bed base plurality of sections comprises said sliding base sized and shaped to match the dimensions of the sofa cushions when stowed in the sofa configuration; said sliding base being hollow such that the air mattress fits within said sliding base when stowed in said sofa base in an open or bed configuration; said sliding base extending outward to said bed base configuration below the sofa by sliding the sliding base outward.

8. The sofa and air mattress combination of claim 7, wherein said sliding base is connected to said lower base via one or more tracks such that said sliding base slides off of and is positioned adjacent to said inner base by moving along said tracks.

9. The sofa and air mattress combination of claim 1 wherein said bed base plurality of sections includes a folding base sized and shaped to match the dimensions of the sofa cushions when stowed in a sofa configuration; said folding base being hollow such that the air mattress fits within said folding base when in an open or bed configuration; said folding base extends outward from below the sofa by unfolding the folding base outward.

* * * * *